US009302469B2

(12) United States Patent
De Grijs

(10) Patent No.: US 9,302,469 B2
(45) Date of Patent: Apr. 5, 2016

(54) METHOD FOR COMPENSATING A FAILING NOZZLE

(71) Applicant: OCE-TECHNOLOGIES B.V., Venlo (NL)

(72) Inventor: Eduard T. H. De Grijs, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/702,257

(22) Filed: May 1, 2015

(65) Prior Publication Data

US 2015/0314591 A1 Nov. 5, 2015

(30) Foreign Application Priority Data

May 2, 2014 (EP) ..... 14166824

(51) Int. Cl.
*B41J 29/393* (2006.01)
*B41J 2/045* (2006.01)
*B41J 2/21* (2006.01)

(52) U.S. Cl.
CPC ..... *B41J 2/0451* (2013.01); *B41J 2/2139* (2013.01); *B41J 2/2146* (2013.01)

(58) Field of Classification Search
CPC ..... B41J 29/393; B41J 29/38; B41J 29/02; B41J 11/42; B41J 2/04505
See application file for complete search history.

(56) References Cited

U.S. PATENT DOCUMENTS

| | | | |
|---|---|---|---|
| 5,124,720 | A | 6/1992 | Schantz |
| 5,581,284 | A | 12/1996 | Hermanson |
| 5,587,730 | A | 12/1996 | Karz |
| 2003/0085939 | A1 | 5/2003 | Koitabashi et al. |
| 2012/0313989 | A1 | 12/2012 | Mantell et al. |
| 2014/0022295 | A1 | 1/2014 | Metcalfe et al. |

FOREIGN PATENT DOCUMENTS

| | | | |
|---|---|---|---|
| EP | 1 060 896 | B1 | 9/2005 |

*Primary Examiner* — Lamson Nguyen
(74) *Attorney, Agent, or Firm* — Birch, Stewart, Kolach & Birch, LLP

(57) ABSTRACT

A method is provided for compensating a failing nozzle in a printhead comprising a series of print elements with nozzles for operation in an inkjet printing process in which a colorant is applied for locally changing an optical density, thereby printing an image. The method comprises at least two compensation mechanisms, each providing a different amount of additional optical density in the environment of a missing dot in the printed image. A nozzle is recorded as a failing nozzle if the associated print element does not apply an ink dot within predetermined specifications. An environment density is determined in an environment of a missing dot associated with said failing nozzle. The environment density is compared with a predetermined threshold, and an appropriate compensation mechanism is selected from the at least two compensation mechanisms. The method is applied in an inkjet printing system for balancing under- and overcompensated optical density.

9 Claims, 4 Drawing Sheets

METHOD FOR COMPENSATING A FAILING NOZZLE

BACKGROUND OF THE INVENTION

1. Field of the Invention

The present invention relates to a method for compensating a failing nozzle in a printhead comprising a series of print elements for operation in an inkjet printing process in which a colorant is applied to a receiving medium for locally changing an optical density, thereby printing an image. The invention further relates to an inkjet printing system comprising control means configured to apply the invented method.

2. Description of the Related Art

Inkjet printing systems are getting increasingly sophisticated. Additional features relating to speed and print quality are continuously introduced for enhancing the range of applicability of inkjet printing systems. Furthermore, the printheads, that form the heart of the inkjet print process, are perpetually improved. Still, it occurs that a print element in a printhead does not discharge an ink drop according to predetermined specifications. Either no ink is applied on positions where an ink dot is supposed to be applied, or an ink dot is applied on a different position from where it is supposed to be applied. The cause of this malfunctioning is often found in the clogging of a nozzle, comprised in the print element, from which the ink is discharged, in residual ink on a nozzle plate of the printhead, or in the introduction of air in the ink channel. Whatever the cause, a non- or malfunctioning print element is known as a failing nozzle. There exist techniques that remediate a failing nozzle, depending on the cause of failing, but these are not the subject of the present invention.

Obviously, a failing nozzle implicates an inferior print quality, since an ink dot can not be provided as required by a control unit of a printer. This ink dot is referred to as a missing dot. The print quality consequence may be debilitated in various ways, depending on the way a printhead is applied in the inkjet printing system. In some systems, a printhead is reciprocated in a scanning direction to print swaths, each swath contributing to a printed image on a receiving sheet-like material. This material is stepwise transported, relative to the beam along which the printhead reciprocates, in a subscanning or transport direction, that is substantially perpendicular to the scanning direction. Alternatively, the printhead beam is moved stepwise across a receiving substrate. In either system, the array of print elements extends in the subscanning direction and a print mode, or print strategy, may be devised wherein a print position on the receiving material is served more than once, each time by a different print element. These print modes are known as multipass print modes. The print data for a specific print position that is served by a failing nozzle of one print element may then be transferred to another print element that is also serving that specific print position. Such a substitution method is the subject of U.S. Pat. No. 5,124,720. Of course, also single pass print modes are known. For these, no similar substitution method is available.

In other print systems, a configuration of one or more printheads, each comprising an array of print elements, extends in a direction substantially perpendicular to a transport direction, which is the direction in which the receiving substrate and the printhead are movable relative to each other. This is also known as a line-type ink jet configuration. The configuration is made as wide as the receiving material on which an image is printed, hence the name page wide printhead array, and the position of the printheads is fixed in the direction perpendicular to the transport direction. Each print position on the substrate is served by a single print element only and the print strategy is essentially a one-pass strategy. Substitution methods as described above, are not applicable for these systems. A method for diminishing the effects of failing nozzles is provided in U.S. Pat. No. 5,587,730. In this patented invention, a second printhead is placed behind a first printhead for each applied colorant, thereby providing a spare nozzle for each print position. However, in most cases, this is not a very economical solution.

In order to compensate a failing nozzle in any of the systems mentioned above, different methods exist that provide additional ink in the neighbourhood of a missing dot, i.e. a dot that would and should be printed by the print element associated with the failing nozzle, if it would function normally. In European patent 1060896 B, a method is described to provide an addressable correction point in the vicinity of a missing dot. This correction point receives the image forming material from a different print element than the print element with the malfunctioning nozzle. In this way, the optical density that the printed material is supposed to achieve, is not affected by the failing nozzle. Another method to retain an optical density is the provision of marking material of another color on the same print position as a missing dot, as elucidated in U.S. Pat. No. 5,581,284. This compensates at least some of the lightness deviation that is caused by a missing dot, although other color properties, such as chroma and hue, still deviate. In all these methods, print data associated with the print element having a failing nozzle is transferred to another print element, applying marking material either or not on the same position as the missing dot. If a print element is capable of applying more than one dot size, a transfer of print data may imply a change of dot size at a neighbouring print position.

However, despite all these possibilities for compensating a failing nozzle, linear imperfections in inkjet printed images still occur. These are especially apparent if the images are printed in a one-pass print system. In spite of an applied compensation, an optical density in a uniform area shows lines of lower optical density, i.e. light lines, but also lines of higher optical density, i.e. dark lines on positions in the printed image associated with failing nozzles. These lines are also referred to as undercompensated failing nozzles and overcompensated failing nozzles, respectively. The present invention addresses this non-uniformity associated with failing nozzles, which is considered to be a problem for some applications of inkjet printing. An object of the present invention is to reduce this non-uniformity.

SUMMARY OF THE INVENTION

According to the present invention, a method is provided for compensating a failing nozzle in a printhead comprising a series of print elements with nozzles for operation in an inkjet printing process in which a colorant is applied to a receiving medium for locally changing an optical density, thereby printing an image, a nozzle being recorded in a list as a failing nozzle if an associated print element is unable to eject an ink drop within predetermined specifications, the method comprising at least two compensation mechanisms, each providing additional optical density in the environment of a missing dot in the printed image associated with a failing nozzle and comprising the steps of a) selecting a failing nozzle from the list of failing nozzles, b) determining an environment density and a density deficit in an environment of a missing dot associated with said failing nozzle, c) comparing the environment density with a predetermined threshold, and d) selecting a compensation mechanism from the at least two compensation mechanisms, based on the result of the comparison, each compensation mechanism adding an amount of colorant to compensate the density deficit. A failing nozzle leads locally to a density deficit due to a shortage of colorant, since the failing nozzle does not apply an ink drop or is controlled not to apply an ink drop. However, if this density deficit is filled up with colorant according to a fixed mechanism for compensating the failing nozzle, in some cases the compensation will be too large, leading to an overcompensated linear defect or a dark line in the printed image, and in other cases the compensation will be too small, leading to an undercompensated linear defect or a light line in the printed image. Of course, there are also situations in which the compensation according to a fixed method is sufficiently redressing the deficit, but this is accidental and not structural. The determination of an environment density around a position in the printed image where the failing nozzle is supposed to supply colorant, enables the selection of an appropriate compensation mechanism. Up to a predetermined threshold, a density deficit may be compensated by a mechanism that is suitable for providing an amount of additional optical density in an environment wherein sufficient positions are available that may accommodate additional colorant. Above this threshold, little or no extra colorant can be provided, since the environment already is filled with a maximum amount of the present colorant and a different mechanism is to be invoked to provide additional optical density. It may also be the case, that above said threshold, the probability of additional colorant overlapping other applied colorant is so high that little or no additional optical density will result. Thus, the additional colorant is not effective in providing additional optical density. In both situations, a different mechanism for compensating a failing nozzle is appropriate. Using the presently invented method, a compensation of a failing nozzle is achieved that better approximates the required optical density in an image and both undercompensation and overcompensation are reduced.

In a further embodiment, the predetermined threshold is dependent on a failing nozzle identifier. The compensation for a failing nozzle is provided by print elements around the failing nozzle. Depending on the accuracy of the dot positioning associated with the print elements around the failing nozzle, a compensation by the neighbouring print elements may have different effect on the optical density around the missing dot associated with the failing nozzle. Therefore, the threshold for selecting a compensation mechanism may be lowered for failing nozzles for which the neighbouring print elements are less effectively compensating the density deficit, whereas the threshold may be raised for failing nozzles for which the neighbouring print elements are very effectively compensating the density deficit.

In a further embodiment, the at least two compensation mechanisms comprise a first mechanism for transferring a signal for ejecting an ink drop to a neighbouring print element of a failing nozzle and a second mechanism for adding ink dots of another colorant in an environment of a missing dot associated with a failing nozzle. The first mechanism involving a neighbouring nozzle starts from an assumption that a neighbouring nozzle, usually applying the same colorant, is able to compensate for the density deficit, either because this neighbouring nozzle would not be enabled if the failing nozzle would be working, or because it is not applying a maximum drop size. This mechanism has a small probability of overlapping dots and therefore the additional optical density may be sufficient. If a resulting extra dot overlaps other dots, more colorant is needed to have sufficient additional optical density. The second mechanism, involving ink dots of another colorant, may give a very large additional density, since there are hardly restrictions on the number of print elements that may be activated for supplying ink in the vicinity of the missing dot. However, it is prudent to apply this latter compensation mechanism only when the environment density is very large, since for low environment density, it may easily produce overcompensation.

In a further embodiment, the compensation method comprises a step of passing a density deficit to a next position in the image associated with said failing nozzle. A density deficit for a specific failing nozzle, in the case the environment density is smaller than the threshold, may be compensated by a first mechanism. If the additional optical density provided by this first mechanism is smaller than the deficit, a part of the deficit remains. In a uniform area in the image, a next position will be compensated in a similar way, leading to an undercompensated line in the image. By passing the remaining deficit to a next position, the total deficit of the next position may exceed the threshold, activating a second compensation mechanism that provides more additional density. Thus, the compensation method incorporates the deficit that is accumulated in a line in a uniform image and undercompensation and overcompensation may alternate to better approximate the needed compensation.

In a further embodiment, a density deficit is determined by optically capturing an output of the inkjet printing process. Monitoring the output enables a determination of the print quality, both in test prints and in regular prints. A density deficit may be determined from the output according to known algorithms, thereby providing information about the effect of the applied compensation mechanisms for failing nozzles. This information is used to further control the compensation method for reducing the occurrence of over- and under compensation.

Further details of the invention are given in the dependent claims. The present invention may also be embodied in an inkjet printing system, comprising control means that are configured to apply a method for compensating a failing nozzle incorporating features as given above and in the claims.

The scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF EMBODIMENTS

Figure 1A:
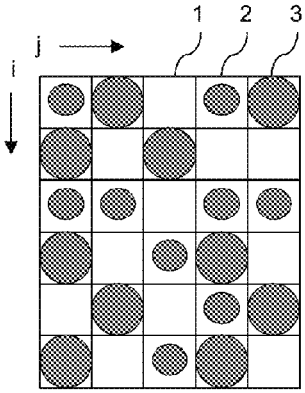
FIGS. 1A, 1B, 1C show dot positions for a low density area and a failing nozzle.

The present invention will now be described with reference to the accompanying drawings, wherein the same or similar elements are identified with the same reference numeral.

Figure 1B:
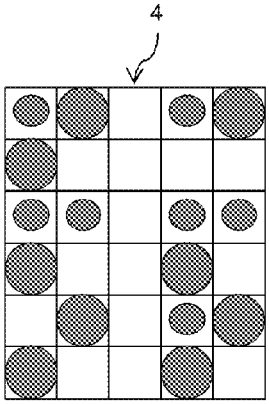
Figure 1C:
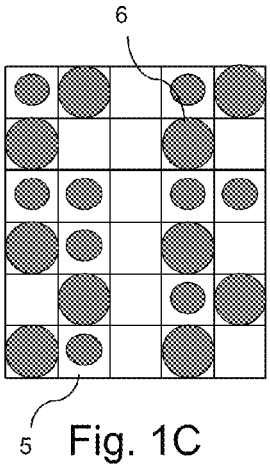

FIG. 1A shows an arrangement of dots that is intended to be produced by an inkjet printer. In this example, two different dot sizes are applied, but this is not essential in the present invention. A larger number of dot sizes is possible, but also a single dot size may be applied. The positions on a receiving medium where a dot may be applied, are often referenced as print pixels. The lines between the print pixels are a guidance for the eye only and are not part of the image as printed. In FIG. 1A, print pixel 1 does not receive a dot, print pixel 2 receives a small dot and print pixel 3 a large dot. The size of the dots is not necessarily limited to the print pixel area, as shown in FIG. 1A, but may just as well extend across the print pixel boundaries. The print pixels are arranged in rows, labeled i, and columns, labeled j. Each column is printed by one and the same print element, comprising a nozzle. The print element is controlled at an appropriate timing to apply an appropriate dot size. However, a print element may not deliver a dot according to predetermined specifications. This print element is designated as having a failing nozzle and most often controlled not to apply ink drops at all. FIG. 1B shows the same dot pattern as in FIG. 1A for the situation wherein the print element corresponding to column 4 comprises a failing nozzle. Locally, ink density is missing, leading to a conspicuous light line. Because the ink density in the dot pattern is not very high, there are print pixels neighbouring the print pixels in column 4, which do not receive an ink dot. Therefore, the missing ink dots in column 4 may be transferred to an open position in a neighbouring column as is done for print pixel 5 in the column on the left side and for print pixel 6 in the column on the right side. This mechanism of transferring an ink dot to a neighbouring print pixel is known in the prior art.

Figure 2A:
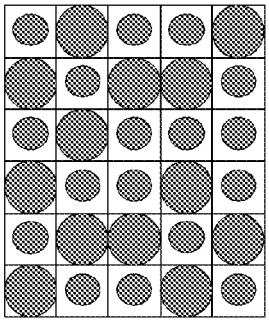
FIGS. 2A, 2B, 2C show dot positions for a moderate density area and a failing nozzle.
Figure 2B:
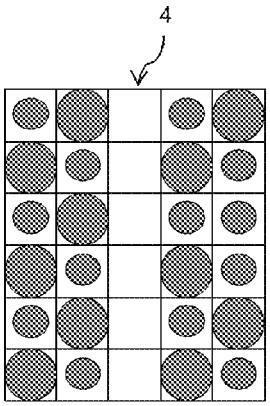
Figure 2C:
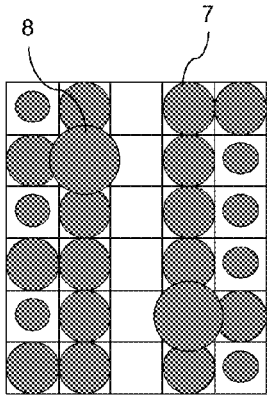

FIG. 2A shows a more dense arrangement of ink dots for an area having a darker appearance than FIG. 1A. Similarly, FIG. 2B shows the effect of a failing nozzle corresponding to column 4. In this case, there are no open positions in neighbouring columns. However, a missing ink density may still be complemented in neighbouring print pixels by increasing the size of the ink dots in these print pixels. In FIG. 2C, print pixel 7 shows an example of this increment. Print pixel 8 represents an extra large ink dot that is only applied to complete a missing neighbouring ink dot and is not applied in a regular pattern. This mechanism is also known in the prior art and is an obvious continuation of the mechanism shown in FIG. 10. Both mechanisms can be viewed as a transfer of a print signal referring to ink density to a neighbouring print pixel.

Figure 3A:
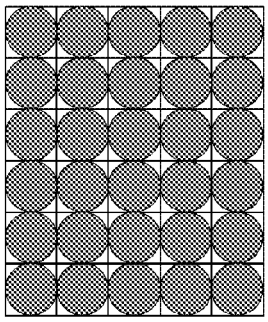
FIGS. 3A, 3B, 3C show dot positions for a high density area and a failing nozzle.
Figure 3B:
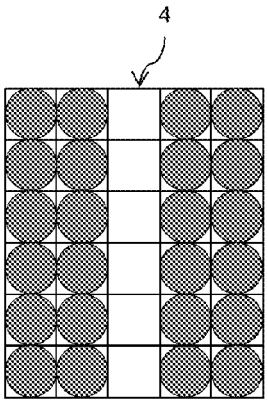
Figure 3C:
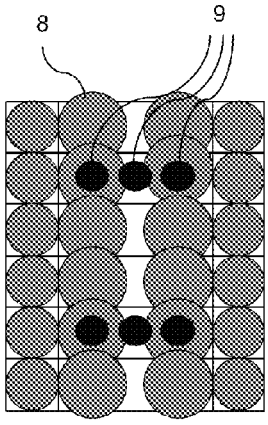

FIG. 3A shows an even more dense arrangement of ink dots. In this case, a failing nozzle corresponding to column 4 may lead again to a light line, as shown in FIG. 3B. If a signal transfer to neighbouring print pixels, as shown in FIG. 3C for print pixel 8, is not sufficiently compensating the missing ink density, a further mechanism may be used for providing extra optical density. In FIG. 3C, this further mechanism involves the addition of ink dots 9 of another colorant around the print pixels corresponding to the failing nozzle of column 4. In order to make sure that the ink dots of the second colorant cover the open print pixel, a number of dots in the row direction is supplied.

Figure 4A:
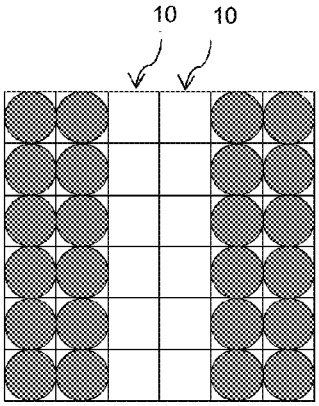
FIGS. 4A, 4B show dot positions for a high density area and two neighbouring failing nozzles.
Figure 4B:
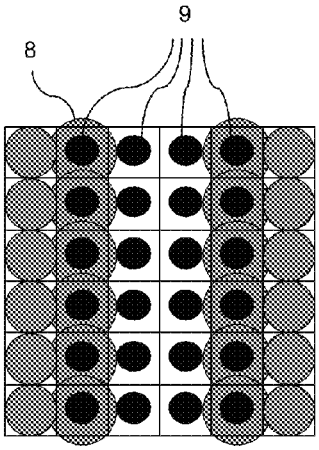

A further extension of the shown mechanisms may be used in the special case that two neighbouring nozzles are failing, as shown in FIG. 4A and FIG. 4B, wherein the failing nozzles correspond to columns 10. In this special case, an even broader pattern of ink dots 9 of another colorant may be used to compensate the missing optical density.

In the mechanisms as described above, a missing optical density, or density deficit, is determined by estimating the effect of the application of an ink drop on the resulting optical density. If a drop is applied in accordance with the calculated pattern, no missing optical density occurs. However, if a failing nozzle is present, an estimation of a missing density is made for an environment of a missing dot and an appropriate compensation mechanism is selected. In a further embodiment, the effect of the compensated pattern on the optical density may be estimated in order to determine whether the compensation is sufficient. If an optical density deficit persists, it may be transferred to a next print pixel in order to have it compensated in this next position. An alternative way to implement a determination of a density deficit is shown in FIG. 5.

Figure 5:
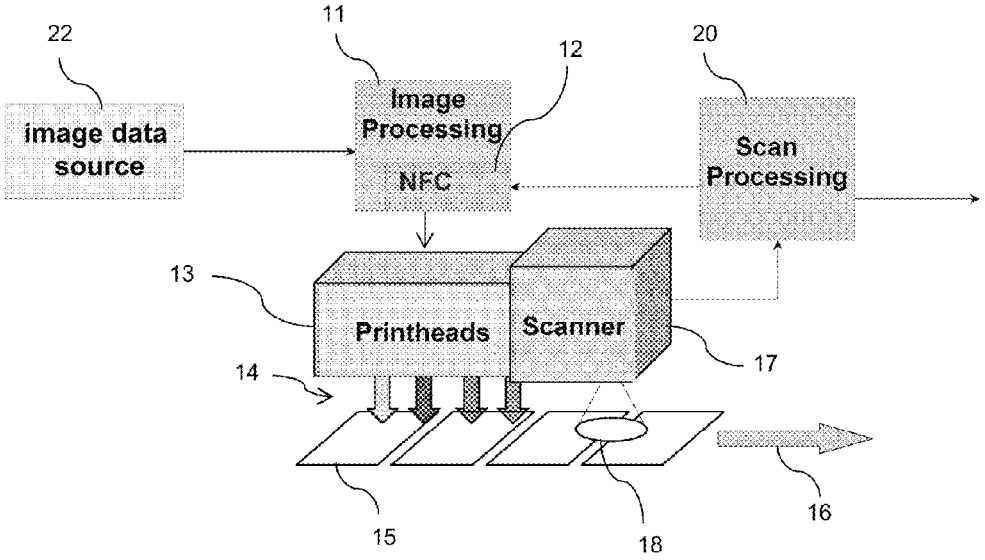
FIG. 5 is an inkjet printing system applying the invented method.

FIG. 5 shows some functional elements in a print system wherein the present invention is implemented. An image data source 22 transfers raster image data to an image processing module 11, wherein the raster image data are converted to print signals. A special section, nozzle failure compensation (NFC) section 12, is dedicated to the processing actions for handling the print signals in the environment of a failing nozzle. In this section the presently invented methods are implemented. The printheads 13 for the colorants cyan, magenta, yellow and black apply the print signals as processed in the image processing module 11 to generate ink drops accordingly. These ink drops are jetted along the direction 14 towards a receiving medium 15 that is transported in the transport direction 16 by a conveyance mechanism that is not shown in this figure. At the arrival on the receiving medium 15, the ink drops take the shape of ink dots corresponding to a pattern as defined by the image processing module 11. The ink dots are monitored by a scanner 17 using an illumination spot 18. The signals from scanner 17, or any other optical capturing device, are sent to a scan processing module 20. This module interprets these scanner signals, among others to update a list of failing nozzles that is shared with the nozzle failure compensation (NFC) section 12, that applies a method according to the present invention. Engine control and maintenance may also use the results of the scan processing module 20. Furthermore, scan processing may comprise a part that estimates an environment density and a density deficit around a nozzle position to provide information on the correctness of the applied compensation.

Figure 6:
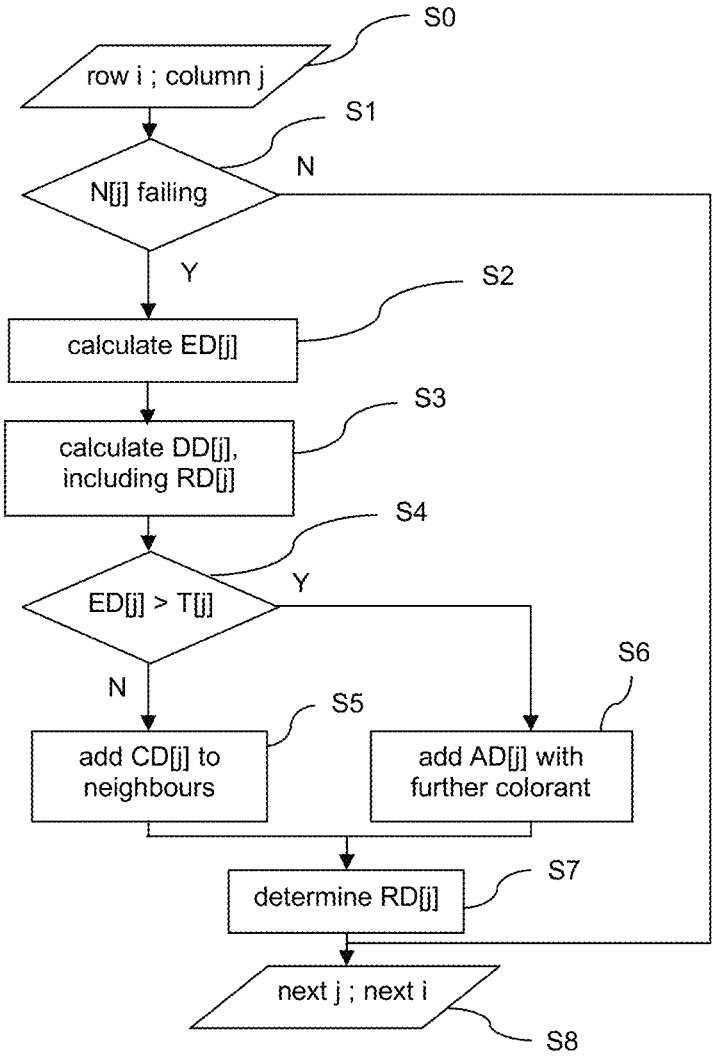
FIG. 6 is a flowchart of an embodiment of the invented method.

FIG. 6 shows a flowchart of the method that has been applied. The pixels of a raster image are arranged in rows numbered i and columns numbered j. A row of pixels is printed in a transverse direction to a transport direction, whereas a column of pixels is oriented in the transport direction. For each colorant, a column of pixels is associated with a single print element. A defect print element, or a failing nozzle, is known by its column number j. In processing a raster image, each color plane is processed separately. The flowchart shows the processing of a single color plane wherein each pixel has an intended colorant density. Step S0 starts the processing loop for a pixel in row i, column j. In step S1, it is checked whether nozzle N[j] is in the list of failing nozzles that is available. If it is not failing (N), the loop jumps to step S8 for a next pixel. If the nozzle N[j] is failing (Y), an environment density ED[j] is calculated from the density of pixels around the current pixel [i,j] in step S1. Furthermore, in step S3, a density deficit DD[j] is determined, wherein a remaining deficit RD[j] from a previous pixel row is included. This density deficit relates to the missing density resulting from the failing nozzle j. In step S4, the environment density ED[j] is compared to a threshold T[j]. Each column j may have a different threshold. If the environment density ED[j] is larger than the threshold T[j] (Y), an additional density AD[j] is provided with another colorant in step S6. In the case of cyan and magenta colorant, an black colorant is added, in the case of black colorant, a combination of cyan and magenta colorant is added. The additional colorant in a different color channel is added to the already present density in that color channel. It may be necessary to limit the total colorant density in dependence of the material of the receiving medium. However, since the failing nozzle does not provide colorant, this limit will not often be traversed. A yellow colorant plane is not subjected to this method, because the optical density of this colorant is not very high. If ED[j] is not larger (N), a compensation density CD[j] of the same colorant is determined and added to neighbouring pixels of the same colorant plane in step S5. After determining these supplementary colorant amounts, a remaining deficit RD[j] is determined in step S7, which is kept to be used in the next row, i+1, in step S3. The use of the remaining deficit RD[j] enables the transfer of an optical density that is not yet compensated for the row i to be compensated in row i+1. The loop started in S0 is repeated, indicated by step S8, until all pixels [i,j] have been addressed.

As an example of the calculations involved in determining the various densities the following tables for three columns of an image are presented for a printer applying 3 sizes of ink drops. Therefore, 4 levels are discerned in the image colorant planes, 0 for no ink drop and 1 to 3 for ink increasing drop volumes. The first three columns indicate the pixel level in a part of the image. Each size of an ink drop is associated with a colorant density in a range of 0 to 255. In this embodiment, level 0, no ink drop, is associated with a density of 0, level 1, the smallest ink drop, is associated with a density of 80, level 2 is associated with a density of 120, and level 3, the largest ink drop, is associated with a density of 150. Columns 4 to 6 indicate an associated optical density D[j] and columns 7 to 9 indicate the optical density DE that results because nozzle j is not jetting ink. Column 10 indicates the environment density ED[j] for the failing nozzle, which is the sum of the optical densities of the nine immediately surrounding pixel densities D[j]. The density deficit DD[j] in column 11 is the difference between the intended environment density ED[j] and its equivalent value in the case of failure of nozzle j. Note that the first and last row are used twice in the calculation of ED[j] to prevent edge effects, which is a usual procedure in image processing. The environment density in this embodiment is calculated for 3 times 3 pixels around a specific pixel corresponding to a failing nozzle. For 600×600 ppi (pixels per inch) images this is a common size, but for higher resolutions, such as 1200×1200 ppi an environment may also comprise 5 times 5 pixels and also anisotropic environments, such as 5 times 3 pixels are possible. However, the essential steps will be the same.

TABLE 1

Image pixel level for a number of columns in an image around a failing nozzle j for six consecutive lines in an image.

| | j − 1 | j | j + 1 | D[j − 1] | D[j] | D[j + 1] | D'[j − 1] | D'[j] | D'[j + 1] | ED[j] | DD[j] |
|---|---|---|---|---|---|---|---|---|---|---|---|
| i | 1 | 1 | 1 | 80 | 80 | 80 | 80 | 0 | 80 | 640 | 240 |
| i + 1 | 1 | 1 | 0 | 80 | 80 | 0 | 80 | 0 | 0 | 720 | 280 |
| i + 2 | 2 | 2 | 1 | 120 | 120 | 80 | 120 | 0 | 80 | 870 | 320 |
| i + 3 | 3 | 2 | 2 | 150 | 120 | 120 | 150 | 0 | 120 | 980 | 390 |
| i + 4 | 3 | 3 | 2 | 150 | 150 | 120 | 150 | 0 | 120 | 1260 | 420 |
| i + 5 | 3 | 3 | 3 | 150 | 150 | 150 | 150 | 0 | 150 | 1320 | 450 |

Using a threshold T[j]=1050, the density deficit is accommodated by different mechanisms. Up to the threshold, pixel levels in the nine pixel environment are raised by an appropriate amount, whereas above the threshold, a further colorant will be used. In this printer, no additional level is available for applying an extra large dot. In Tables 2a to 2f, it is indicated how the density deficit DD[j] is compensated. The rows are updated one by one and the updated value is represented in the table. The density deficit DD'[j] includes the remaining deficit RD[j] from the previous row. The remaining density RD[j] is the difference between the intended environment density ED[j] and the environment density ED'[j] after processing an image line. The optical density D"[j] is updated to compensate the deficit DD'[j] by raising the density levels in the row under consideration and adding a level 1 drop if in the environment an empty position, which is level 0, occurs. If the environment density ED[j] is above the threshold, which is indicated by underlining the deficit values, an additional density AD[j] is applied by using a different colorant, as described before. The numerical values used are just for illustrative purposes and may be adapted to a specific process or print conditions. The pixel levels in the last three columns are derived from the density levels D"[j]. When processing a specific line, the densities D"[j] of previous lines have already been processed and these processed values are used in determining ED'[j].

TABLE 2a

Compensated pixel values for the image part of Table 1 after processing line i.

| | DD[j] | DD'[j] | D"[j − 1] | D"[j] | D"[j + 1] | AD[j] | ED'[j] | RD[j] | j − 1 | j | j + 1 |
|---|---|---|---|---|---|---|---|---|---|---|---|
| i | 240 | 240 | 120 | 0 | 120 | 0 | 560 | 80 | 2 | 0 | 2 |
| i + 1 | 280 | 0 | 80 | 0 | 0 | 0 | 720 | 0 | 1 | 0 | 0 |

TABLE 2b

Compensated pixel values for the image part of Table 1 after processing line i + 1.

| | DD[j] | DD'[j] | D"[j − 1] | D"[j] | D"[j + 1] | AD[j] | ED'[j] | RD[j] | j − 1 | j | j + 1 |
|---|---|---|---|---|---|---|---|---|---|---|---|
| i | 240 | 240 | 120 | 0 | 120 | 0 | 560 | 80 | 2 | 0 | 2 |
| i+1 | 280 | 360 | 150 | 0 | 120 | 0 | 710 | 10 | 3 | 0 | 2 |
| i+2 | 320 | 0 | 120 | 0 | 80 | 0 | 870 | 0 | 2 | 0 | 1 |

TABLE 2c

Compensated pixel values for the image part of Table 1 after processing line i + 2.

| | DD[j] | DD'[j] | D"[j − 1] | D"[j] | D"[j + 1] | AD[j] | ED'[j] | RD[j] | j − 1 | j | j + 1 |
|---|---|---|---|---|---|---|---|---|---|---|---|
| i | 240 | 240 | 120 | 0 | 120 | 0 | 560 | 80 | 2 | 0 | 2 |
| i + 1 | 280 | 360 | 120 | 0 | 120 | 0 | 680 | 10 | 2 | 0 | 2 |
| i + 2 | 320 | 330 | 150 | 0 | 150 | 0 | 840 | 30 | 3 | 0 | 3 |
| i + 3 | 390 | 0 | 150 | 0 | 120 | 0 | 980 | 0 | 3 | 0 | 2 |

TABLE 2d

Compensated pixel values for the image part of Table 1 after processing line i + 3.

| | DD[j] | DD'[j] | D"[j − 1] | D"[j] | D"[j + 1] | AD[j] | ED'[j] | RD[j] | j − 1 | j | j + 1 |
|---|---|---|---|---|---|---|---|---|---|---|---|
| i | 240 | 240 | 120 | 0 | 120 | 0 | 560 | 80 | 2 | 0 | 2 |
| i + 1 | 280 | 360 | 120 | 0 | 120 | 0 | 680 | 10 | 2 | 0 | 2 |
| i + 2 | 320 | 330 | 150 | 0 | 150 | 0 | 840 | 30 | 3 | 0 | 3 |
| i + 3 | 390 | 420 | 150 | 0 | 150 | 0 | 870 | 110 | 3 | 0 | 3 |
| i + 4 | 420 | 0 | 150 | 0 | 120 | 0 | 1260 | 0 | 3 | 0 | 2 |

TABLE 2e

Compensated pixel values for the image part of Table 1 after processing line i + 4.

| | DD[j] | DD'[j] | D"[j − 1] | D"[j] | D"[j + 1] | AD[j] | ED'[j] | RD[j] | j − 1 | j | j + 1 |
|---|---|---|---|---|---|---|---|---|---|---|---|
| i | 240 | 240 | 120 | 0 | 120 | 0 | 560 | 80 | 2 | 0 | 2 |
| i + 1 | 280 | 360 | 120 | 0 | 120 | 0 | 680 | 10 | 2 | 0 | 2 |
| i + 2 | 320 | 330 | 150 | 0 | 150 | 0 | 840 | 30 | 3 | 0 | 3 |
| i + 3 | 390 | 420 | 150 | 0 | 150 | 0 | 870 | 110 | 3 | 0 | 3 |
| i + 4 | 420 | 530 | 150 | 0 | 150 | 200 | 1100 | 160 | 3 | 0 | 3 |
| i + 5 | 450 | 0 | 150 | 0 | 150 | 0 | 1320 | 0 | 3 | 0 | 3 |

TABLE 2f

Compensated pixel values for the image part of Table 1 after processing line i + 5.

| | DD[j] | DD'[j] | D"[j − 1] | D"[j] | D"[j + 1] | AD[j] | ED'[j] | RD[j] | j − 1 | j | j + 1 |
|---|---|---|---|---|---|---|---|---|---|---|---|
| i | 240 | 240 | 120 | 0 | 120 | 0 | 560 | 80 | 2 | 0 | 2 |
| i + 1 | 280 | 360 | 120 | 0 | 120 | 0 | 680 | 10 | 2 | 0 | 2 |

TABLE 2f-continued

| Compensated pixel values for the image part of Table 1 after processing line i + 5. | | | | | | | | | | | |
|---|---|---|---|---|---|---|---|---|---|---|---|
| | DD[j] | DD'[j] | D''[j − 1] | D''[j] | D''[j + 1] | AD[j] | ED'[j] | RD[j] | j − 1 | j | j + 1 |
| i + 2 | 320 | 330 | 150 | 0 | 150 | 0 | 840 | 30 | 3 | 0 | 3 |
| i + 3 | 390 | 420 | 150 | 0 | 150 | 0 | 870 | 110 | 3 | 0 | 3 |
| i + 4 | 420 | 530 | 150 | 0 | 150 | 200 | 1100 | 160 | 3 | 0 | 3 |
| i + 5 | 450 | 510 | 150 | 0 | 150 | 200 | 1500 | −180 | 3 | 0 | 3 |

In this embodiment, the environment density and density deficit are estimated from a predetermined correspondence between ink drop levels and density. Alternatively, these densities are established optically by an arrangement of an optical capturing device, such as scanner 17 in FIG. 5. In either way, the nozzle failure compensation is tuned to an amount of colorant density that is being short as a consequence.

The invention being thus described, it will be obvious that the same may be varied in many ways. Such variations are not to be regarded as a departure from the scope of the invention, and all such modifications as would be obvious to one skilled in the art are intended to be included within the scope of the following claims.

What is claimed is:

1. A method for compensating a failing nozzle in a printhead comprising a series of print elements with nozzles for operation in an inkjet printing process in which a colorant is applied to a receiving medium for locally changing an optical density, thereby printing an image, a nozzle being recorded in a list as a failing nozzle if an associated print element is unable to eject an ink drop within predetermined specifications, the method comprising at least two compensation mechanisms, each providing additional optical density in an environment of a missing dot in the printed image associated with a failing nozzle and comprising the steps of:

a) selecting a failing nozzle from the list of failing nozzles;

b) determining an environment density and a density deficit in an environment of a missing dot associated with said failing nozzle;

c) comparing the environment density with a predetermined threshold, and d) selecting a compensation mechanism from the at least two compensation mechanisms, based on the result of the comparison, each compensation mechanism adding an amount of colorant to compensate the density deficit, wherein said at least two compensation mechanisms comprise a first mechanism for transferring a density deficit compensation to a neighbouring print element of a failing nozzle and a second mechanism for transferring a density deficit compensation to corresponding nozzle of a different colorant.

2. The method according to claim 1, wherein the predetermined threshold is dependent on a failing nozzle identifier.

3. The method according to claim 2, wherein a dependency of the predetermined threshold on a failing nozzle identifier is established by optically capturing a result of a failing nozzle compensation.

4. The method according to claim 1, wherein the first mechanism comprises the steps of:

a) inspecting an environment of a missing dot associated with the failing nozzle for a vacant dot position in the image;

b) if a vacant dot position is found, transferring said density deficit compensation to a print element associated with the vacant dot position, and c) if no vacant dot position is found, transferring said density deficit compensation to several print elements in the environment of a missing dot associated with the failing nozzle.

5. The method according to claim 1, wherein the method further comprises a step of passing a density deficit, which remains after compensating said failing nozzle, to a next position in the image associated with said failing nozzle.

6. The method according to claim 1, wherein said amount of colorant to compensate the density deficit is corrected for an amount of overlap between ink drops of various print elements in an environment of a failing nozzle.

7. The method according to claim 1, wherein a print element is configured to eject ink drops of different volumes, each of the drop volumes resulting in a different local change of optical density of the receiving medium.

8. The method according to claim 1, wherein the environment density is determined by optically capturing an output of the inkjet printing process.

9. An inkjet printing system, comprising control means that are configured to apply a method for compensating a failing nozzle according to claim 1.

* * * * *